United States Patent [19]

Shimomura

[11] Patent Number: 4,672,717

[45] Date of Patent: Jun. 16, 1987

[54] APPARATUS FOR SWINGING NIPPER FRAME OF COMBER

[75] Inventor: Manabu Shimomura, Gifu, Japan

[73] Assignee: Kabushikikaisha Hara Shokki Seisakusho, Gifu, Japan

[21] Appl. No.: 883,347

[22] Filed: Jul. 8, 1986

[30] Foreign Application Priority Data

Jul. 13, 1985 [JP] Japan ..... 60-153394

[51] Int. Cl.[4] ..... D01C 19/14

[52] U.S. Cl. ..... 19/225; 19/235

[58] Field of Search ..... 19/225, 235

[56] References Cited

U.S. PATENT DOCUMENTS

| | | | |
|---|---|---|---|
| 3,184,799 | 5/1965 | Gauvain | 19/225 |
| 3,320,643 | 5/1967 | Katori | 19/225 |
| 3,479,699 | 11/1969 | Von Kaenel et al. | 19/225 X |
| 3,600,758 | 8/1971 | Von Kaenel et al. | 19/225 |

FOREIGN PATENT DOCUMENTS

| | | | |
|---|---|---|---|
| 533762 | 5/1922 | France . | |
| 1562179 | 4/1969 | France | 19/225 |
| 2248821 | 11/1985 | Japan | 19/235 |
| 286068 | 10/1952 | Switzerland . | |
| 485873 | 3/1970 | Switzerland . | |
| 699861 | 11/1953 | United Kingdom . | |

*Primary Examiner*—Louis K. Rimrodt

*Attorney, Agent, or Firm*—Burns, Doane, Swecker & Mathis

[57] ABSTRACT

The front end portion of a cushion plate (5) provided on the front end of a nipper frame (4) is swung along an upwardly facing arc (25), i.e., an arc with an inner side facing away from the combing cylinder (3). The nipper frame (4) with the cushion plate (5) is constructed as a four-joint link mechanism which consists of the nipper frame (4), a nipper shaft (10), nipper frame setting fulcrum (7), nipper frame driving arm (11), and nipper frame swing arm (8).

2 Claims, 10 Drawing Figures

APPARATUS FOR SWINGING NIPPER FRAME OF COMBER

BACKGROUND OF THE INVENTION

1. Field of the Invention

The present invention relates to a method and apparatus for swinging the nipper frame of a cotton comber, more particularly, to a swinging method and apparatus of a nipper frame which is constructed so that the front end portion of a cushion plate provided on the front end of the nipper frame is swung with respect to a combing cylinder of a comber along a convex circular arc.

2. Description of the Related Art

In a cotton comber, a firber web (ordinarily called a "lap") supplied to the combing mechanism of the comber is gripped between a cushion plate and descending nipper knife when the cushion plate retracts. As the cushion plate retracts, the gripped web approaches the combing cylinder, and, near the rearmost end of the swing of the cushion plate, undergoes the combing action of the needles of the combing cylinder to become a thin fiber sheet, that is, a fleece.

After this, the cushion plate enters its forward motion and approaches the backside of the detaching roller. At this time, the detaching roller reverses to send the fleece backward so this, fleece receives on the top surface of its center portion the front end of the fleece on the cushion plate and undergoing the combing action. At this time, the nipper knife rises away from the cushion plate to release the grip on the web. The detaching roller then rotates normally and the fleece goes forward. At this time, the back side of the fleece is combed by the top comb descending between the detaching roller and nipper knife.

Various swinging methods and apparatuses are in use in cotton combers, but there are still problems when the combing action is performed by the methods and apparatuses of the prior art, the gauge in the combing zone between the front end of the cushion plate and the needles of the combing cylinder cannot be held constant, making it difficult to obtain fine combing slivers. Also during working, vibration and wear of parts of the comber are high and high speed operation is difficult. Further, the nipper frame setting fulcrum is under the combing cylinder, which makes maintenance work difficult and unsafe.

SUMMARY OF THE INVENTION

It is an object of the present invention to provide a swinging method and apparatus which resolves the aforementioned problems in known nipper frame swinging of maintaining an extremely constant gauge between the front end of the cushion plate and the needle of the combing cylinder, vibration, and maintenance.

The object of the present invention is achieved by means of a swinging method of a nipper frame characterized by swinging the front end of the cushion plate provided on the front end of the nipper frame so that it follows an upward facing arc comprising a succession of a plurality of arcs having centers of curvature at successive moving points located above the nipper frame and so that when the nipper plate retracts to the rearmost position the front end of the cushion plate most approaches the combing cylinder.

As the apparatus for realizing the swinging method, there may be used a nipper frame swinging apparatus of a comber consisting of a nipper frame arranged above the combing cylinder of the comber and having a cushion plate on its front end; a nipper shaft arranged for reciprocating rotation on the machine frame of the comber at a position above the nipper frame; a nipper frame setting fulcrum provided on the machine frame at a position above the nipper frame and a position more forward than the nipper shaft; a nipper frame driving arm with a top end fixed to the nipper shaft and a bottom end pivoted to a nipper frame driving fulcrum located at the back of the nipper frame; and a nipper frame swing arm with a top end pivoted to the nipper frame setting fulcrum and a bottom end pivoted to a nipper frame swing fulcrum located at the front of the nipper frame.

DESCRIPTION OF THE PREFERRED EMBODIMENTS

Before describing the preferred embodiments, a detailed explanation of the prior art will be made for reference.

Figure 1:
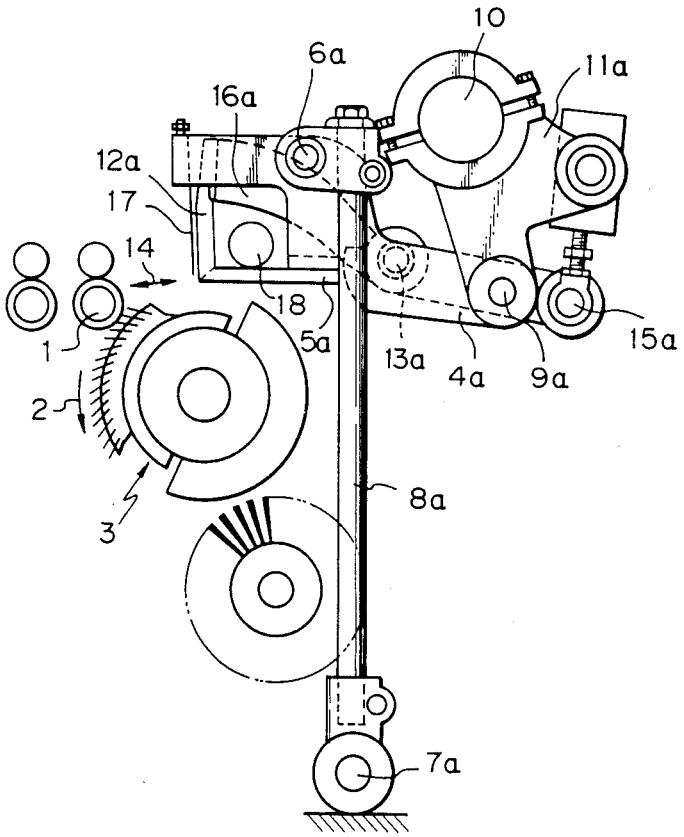
Fig. 1 PRIOR ART
FIG. 1 is a schematic cross-sectional view of a comber of a prior art nipper frame swing apparatus.
Figure 2:
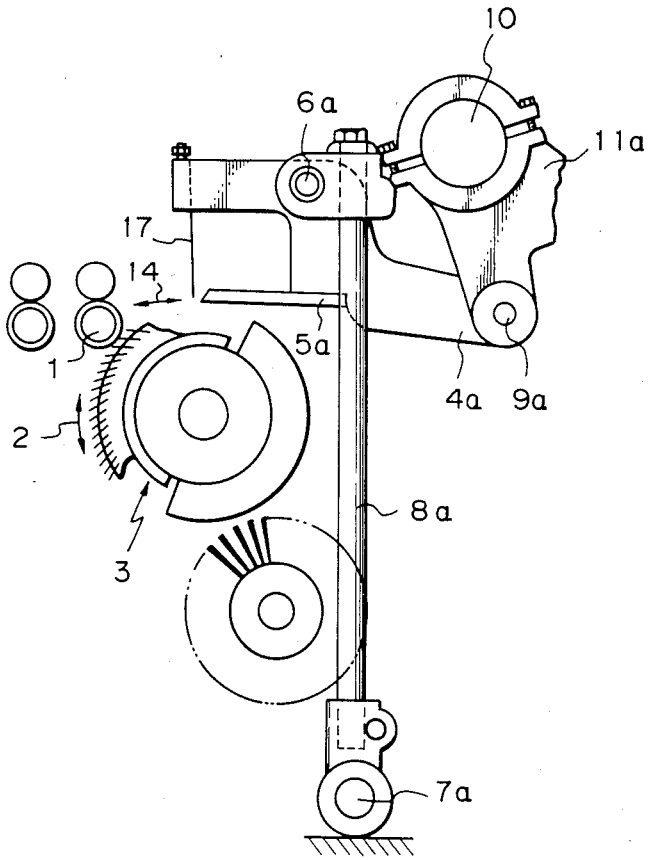
Fig. 2 PRIOR ART
FIG. 2 is a schematic cross-sectional view the same as FIG. 1 but with the nipper knife arm omitted.

FIGS. 1 and 2 show a typical example of a swing apparatus for a cushion plate for the combing action of a cotton comber and a nipper frame supporting the cushion plate.

FIG. 1 shows the actual constitution with a nipper frame 4*a* and nipper knife arm 16*a* combined. FIG. 2 shows the connection of the nipper frame 4*a* in detail with the nipper knife arm 16*a* omitted so as to clarify the construction.

In the Figures, 17 indicates a top comb, and 18 a feed roller upon a cushion plate 5*a*. In the comber, a combing cylinder 3 which rotates in the direction indicated by the arrow 2 is provided upstream of a detaching roller 1.

The cushion plate 5*a* is mounted to the nipper frame 4*a* and performs forward-backward swing motion in the direction of the arrow 14 above the combing cylinder 3. This swing motion derives from the reciprocating rotational motion of a nipper shaft 10. In the hitherto known nipper frame swing apparatus, the cushion plate 5*a* is swung by a four-joint link mechanism.

The four-joint link mechanism is constructed by (1) the nipper frame 4*a*, (2) the nipper shaft 10 arranged for reciprocating rotation on the machine frame of the comber at a position above the nipper frame, (3) a nipper frame setting fulcrum 7*a* mounted on a frame different from the machine frame where the nipper shaft 10 is arranged and at a position under the nipper frame 4*a*, (4) a nipper frame driving arm 11*a* with an upper end fixed to the nipper shaft 10 and a bottom end pivoted on a nipper frame driving fulcrum 9*a* provided at the back of the nipper frame 4*a*, and (5) a nipper frame swing arm 8 with an upper end pivoted at a nipper frame swing fulcrum 6*a* located at the front of the nipper frame and a bottom end pivoted at the nipper frame setting fulcrum 7*a*.

A nipper knife arm 16*a* having a nipper knife 12*a* on its front end is supported by a nipper knife arm supporting fulcrum 13*a* provided on the nipper arm 4*a* and by a nipper knife arm driving fulcrum 15*a* where motion of the nipper frame driving arm 11*a* is delivered.

As clearly shown in FIG. 1, most of the weight of the nipper knife arm 16*a* is applied to the nipper frame 4*a* through the nipper knife arm supporting fulcrum 13*a*. Therefore most of the weight of the nipper frame 4*a* and nipper knife arm 16*a* act on the nipper frame setting fulcrum 7*a* through the nipper frame swing arm 8*a*. This weight usually reaches about 13 kg and 150 to 250 swing motions are performed per minute, so harsh conditions are imposed on the nipper frame setting fulcrum 7*a*.

Figure 3:
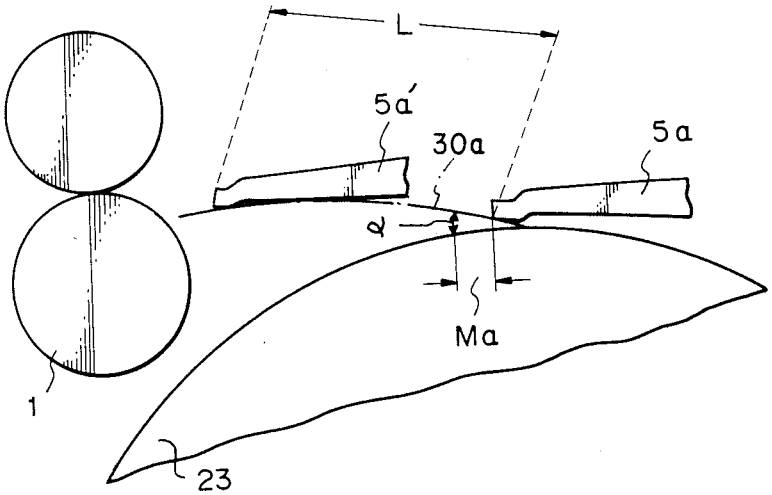
Fig. 3 PRIOR ART
FIG. 3 is a partial cross-sectional view for explaining the swing path of a front end of the cushion plate of the nipper frame shown in FIG. 1.
Figure 9:
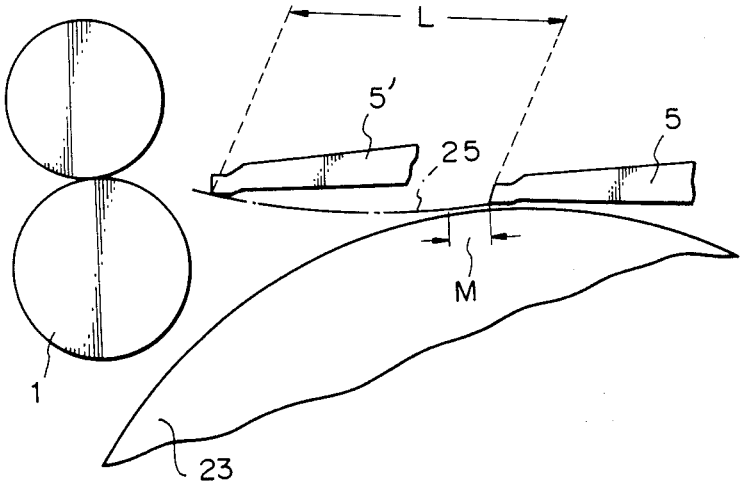
FIG. 9 is a partial cross-sectional view of a comber for explaining the swing path of a front end of the cushion plate in the comber of FIG. 7.

FIG. 3 shows the swing path 30 of the front end of the cushion plate in the case of use of the nipper frame swing apparatus shown in FIGS. 1 and 2.

In FIG. 3, numeral 23 is the circular path of the front end of the needles of the combing cylinder 3. At the position of the cushion plate indicated by 5*a* in FIG. 3, the web is combed by the needles of the combing cylinder (in zone 17*a*). The cushion plate then goes to the position indicated by 5*a'* along a downward facing arc, i.e., an arc whose inner side faces the combing cylinder 3, and deliver the fleece to the detaching roller 1.

As the nipper frame setting fulcrum 7*a* is below the cylinder 3, however, there is the problem that the nipper frame swing arm 8*a* has to be long. To ensure sufficient rigidity of this long arm, it has be thick. This increases the inertia of the four-joint link mechanism and results in conspicuous wear of the bearings of the nipper shaft 10, nipper frame swing fulcrum 6*a*, nipper frame setting fulcrum 7*a*, and nipper frame driving fulcrum 9*a*. This in turn would require more frequent maintenance of the comber and increase maintenance costs.

Also, since most of the weight of the nipper frame swing apparatus 7*a* is applied to one point of the nipper frame setting fulcrum 7*a* and since the nipper frame 4*a* swings supported by the nipper frame swing fulcrum 6*a* arranged at the top of the long nipper frame swing arm 8*a*, there is the problem of strong vibration of the comber frame.

As the frame holding the bearing of the nipper shaft 10 is different from the frame holding the nipper frame setting fulcrum 7*a*, it is difficult to precise position the setting fulcrums 7*a* of the arms 8*a* supporting the right and left nipper frames 4*a* with respect to the nipper shaft 10. As a result, the gauge (FIG. 3, $\alpha$) between the front end of the cushion plate 5*a* and the combing cylinder 3 easily becomes irregular. This results in unevenness of the combing action on the widely fed web by the needles of the combing cylinder 3 and thus makes it difficult to obtain a good quality combed sliver.

As the nipper frame setting fulcrum 7*a* is mounted below the cylinder 3, the maintenance work for the bottom ends of the cylinder 3 is difficult.

As shown in FIG. 3, the swing path 30*a* of the front end of the cushion plate is a downwardly facing arc. The front end of the swing path 30*a* must face the detaching roller 1, so the arc be arranged with the front end, namely the left side in FIG. 5, upwardly inclined. Due to this, in the zone Ma of web combing, a difference arises in the gauge $\alpha$ between the front end of the cushion plate and the combing cylinder. As a result, a problem arises in the combing action.

Similarly, as the swing path 30*a* of the front end of the cushion plate 5*a* is a downwardly facing arc, to have the cushion plate 5*a* evenly approach the cylinder 3, the swing length L of the cushion plate 5*a* must be made large. Accordingly, the swing angle of the nipper frame swing arm 8*a* must be made large. This causes a problem a large vibration of the frame.

The fiber web is intermittently fed onto the cushion plate 5*a* by the feed roller 18, shown in FIG. 1. This feed roller 18 draws the same arc as the cushion plate 5*a*. As a result, the web is subjected to irregular stretch conditions, i.e., is stretched most when the nipper frame 4*a* advances, slackens at the middle of the arc motion, and is slightly stretched when the nipper retracts. If such irregular stretch conditions occur in one reciprocating combing action, an unevenness of weight occurs in combed sliver: a serious defect. Hitherto fore, a special lap tensioning apparatus was added to solve this problem.

Figure 5:
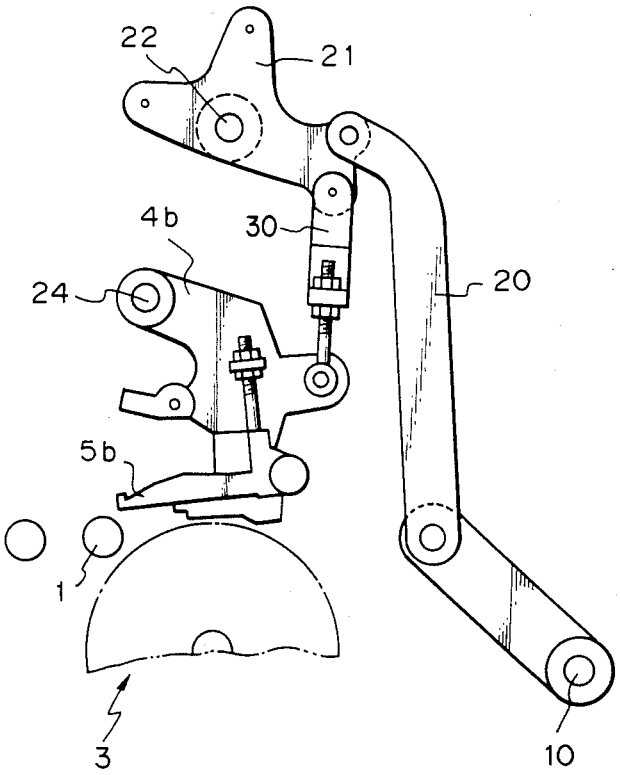
Fig. 5 PRIOR ART
FIG. 5 is a schematic cross-sectional view the same as FIG. 4 but with the nipper knife arm omitted.
Figure 6:
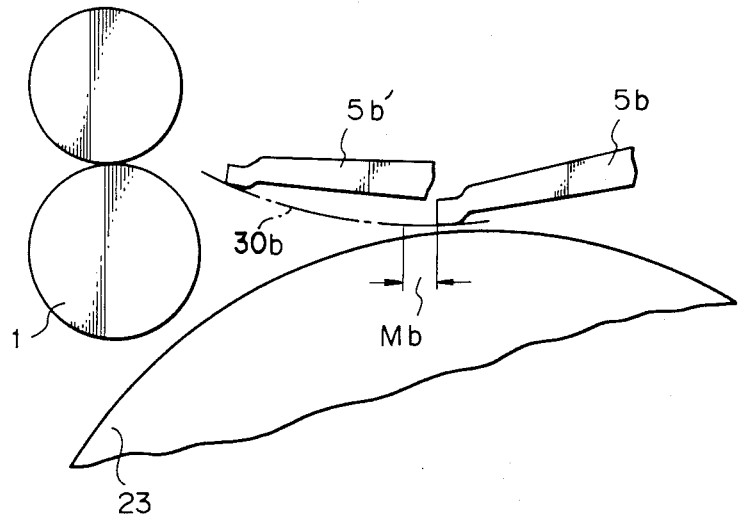
Fig. 6 PRIOR ART
FIG. 6 is a partial cross-sectional view of a comber for explaining the swing path of a front end of the cushion plate of the nipper frame swing apparatus shown in FIG. 4.

Another known nipper frame swing apparatus will be explained with reference to FIGS. 4 and 5. FIG. 5 shows in detail the connection of the nipper frame 4*b*, omitting the nipper knife arm 16*b* for ease of understanding. This nipper frame swing apparatus also causes swinging by reciprocating rotational motion of the nipper shaft 10. Namely, the reciprocating rotational motion of the nipper shaft 10 is converted into swing motion centered on a fulcrum 22 of a compound lever 21 by a link 20. On the other hand, the nipper frame 4*b*, to whose bottom portion the cushion plate 5*b* is connected is pivoted at a fulcrum 24. One end of the compound lever 21 and one end of the nipper frame 4*b* are connected by the connecting link 30 with adjustment screws. As a result, the reciprocating rotational motion of the nipper shaft 10 causes the front end of the cushion plate 5*b* to swing along an arc centered on the fulcrum 24. FIG. 6 shows the swing path 30*b* of cushion plate 5*b*.

Figure 4:
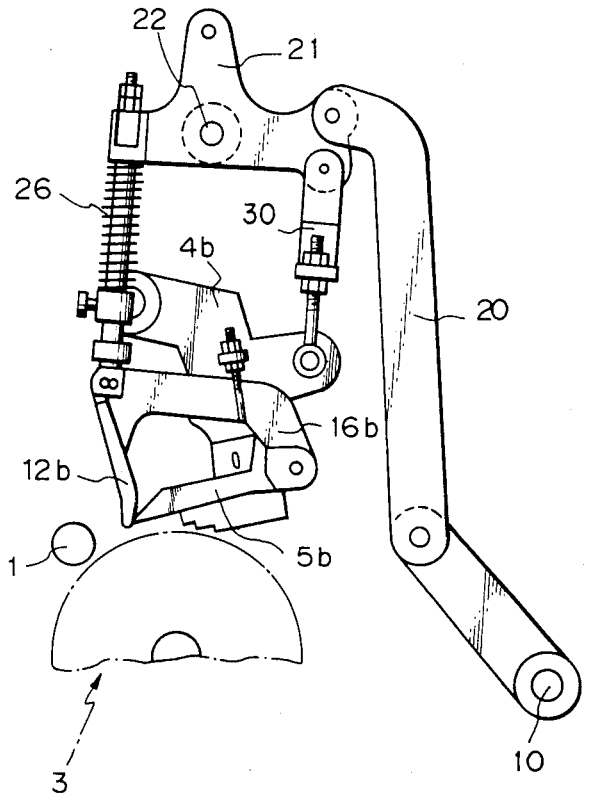
Fig. 4 PRIOR ART
FIG. 4 is a schematic cross-sectional view of a comber of another prior art nipper frame swing apparatus.

On the other hand, as shown in FIG. 4, the nipper knife arm 16*b* is pivoted at one end to the nipper frame 4*b* and connected at its other end to on one end of the compound lever 21 via a spring 26. As a result, along with the reciprocating rotational motion of the nipper shaft the nipper knife 12*b* is pressed to the cushion plate 5*b* by the spring 26.

Use of the nipper frame swing apparatus shown in FIGS. 4 and 5 enables elimination of some of the aforementioned problems of the nipper frame swing apparatus of FIGS. 1 and 2, but suffer from new problems.

First, as illustrated in FIGS. 4 and 5, the mechanism for swinging the nipper frame is complicated. Further, the fulcrum 24 receives the whole weight of the nipper frame swing apparatus, so there is large vibration and bearing wear of the fulcrum 24. Therefore, high speed operation of this swing apparatus is not possible.

Second, a problem arises since the swing motion of the nipper frame is an arc motion with a fixed center of curvature, i.e., the fulcrum 24. Namely, in the comber, the combing zone (Mb in FIG. 6) must be generally parallel to the needles of the combing cylinder.

In the nipper frame swing apparatus of FIGS. 4 and 5, this requires the fulcrum 24 be placed far from the combing cylinder, which in turns necessitates the nipper frame be large in the vertical direction. As a result, vibration of the nipper frame swing apparatus becomes large. In actuality, there is a limit on how large the nipper frame can be made in the vertical direction and it must be confined to a certain length. For this purpose, in the combing zone, the gauge between the front end of cushion plate 5*b* and needles of the combing cylinder varies and, thus, a uniform combing action cannot be achieved.

Embodiments of the invention will now be explained with reference to the drawings.

Figure 7:
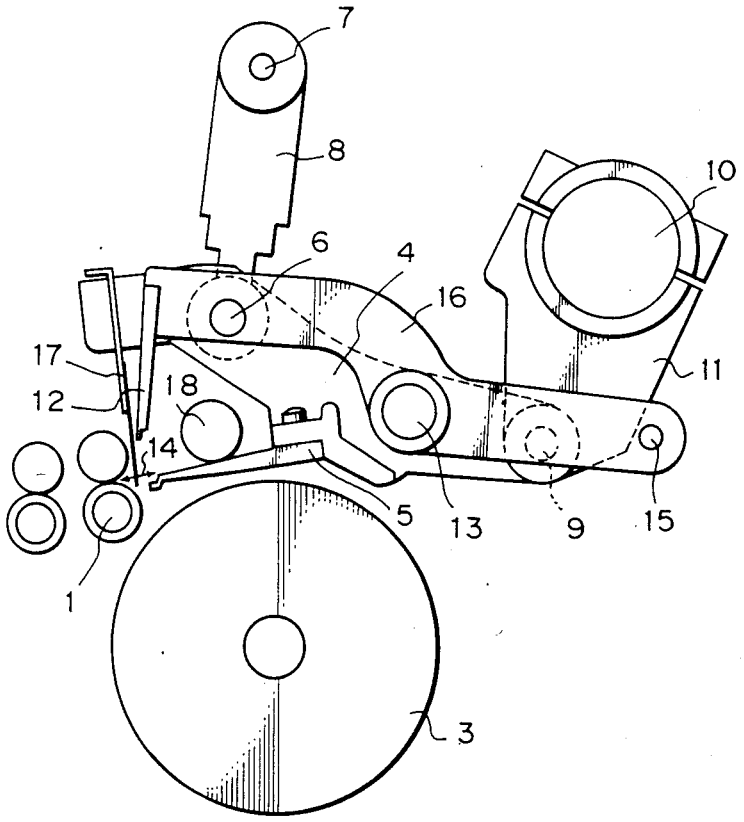
FIG. 7 is a schematic sectional view of an embodiment of a nipper frame swing apparatus accordance to the present invention.
Figure 8:
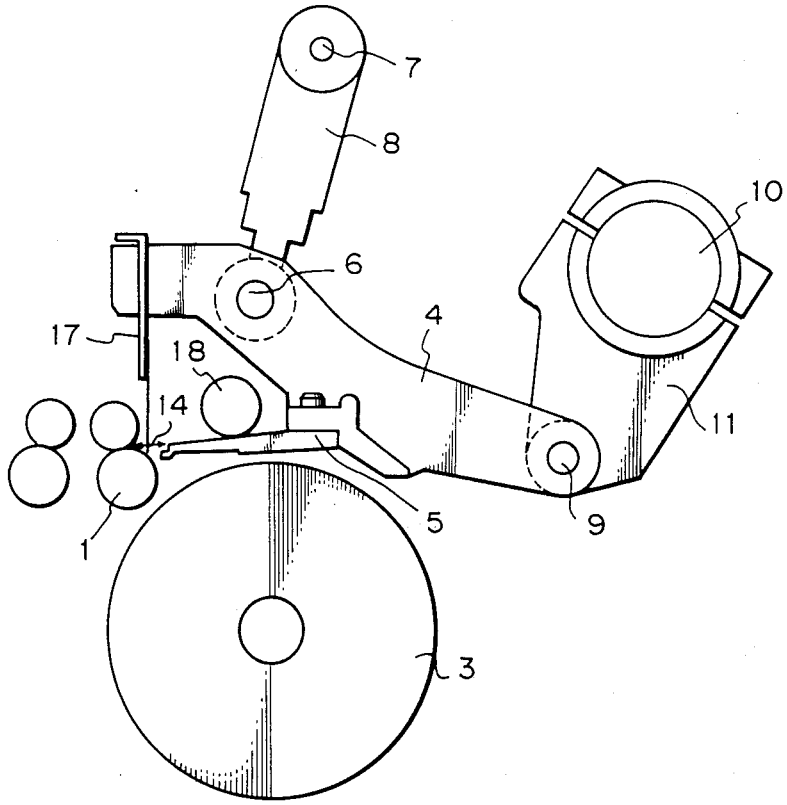
FIG. 8 is a schematic sectional view the same as FIG. 7 but with the nipper knife arm omitted.

FIG. 7 shows the actual construction of a nipper frame swing apparatus with the nipper frame 4 and nipper knife arm 16 combined. FIG. 8 shows in detail the connection of the nipper frame 4, with the nipper knife arm 16 omitted for ease of understanding. In the drawings, numeral 1 shows a detaching roller, 3 a combing cylinder, 17 a top comb attached to the top of a nipper frame, and 18 a feed roller above the cushion plate.

The nipper knife arm 16, which has the nipper knife 12 on its front end, is supported by a nipper knife arm supporting fulcrum 13 arranged on the nipper arm 4 and separately by a nipper knife arm driving fulcrum 15 where the motion of the nipper frame driving arm 11 is transmitted.

The cushion plate 5, as shown in the drawings, is mounted to the nipper frame 4 and performs forward-backward swing motion over the combing cylinder 3 in the direction indicated by the arrow 14. This swing motion derives from the reciprocating rotational motion of the nipper shaft 10.

In the nipper frame swing apparatus of this invention, as shown in FIG. 8, the cushion plate 5 is also swing by a four-joint link mechanism. The four-joint link mechanism consists of (1) the nipper frame 4, (2) the nipper shaft 10 arranged for reciprocating rotation to the machine frame of the comber at the top of the nipper frame, (3) a nipper frame setting fulcrum 7 provided on the machine frame at the top of the nipper frame and in front of the nipper shaft 10, (4) a nipper frame driving arm 11 fixed at its top end to the nipper shaft 10 and pivoted at its bottom end to a nipper frame driving fulcrum 9 placed at the back of the nipper frame 4, and (5) a nipper frame swing arm 8 pivoted at its top end to the nipper frame setting fulcrum 7 and pivoted at its bottom end to a nipper frame swing fulcrum 6 placed in front of the nipper frame 4.

Figure 10:
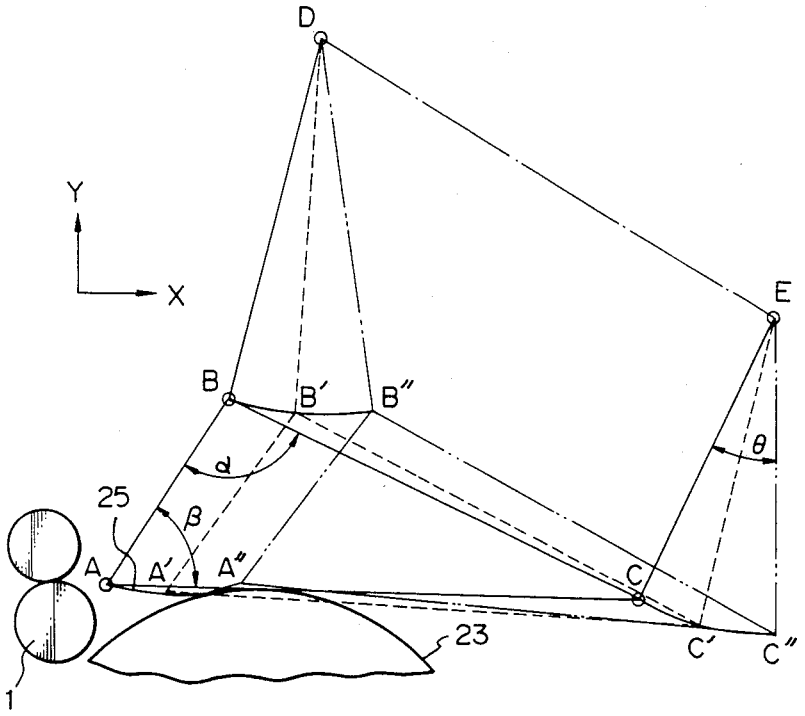
FIG. 10 is a diagrammatic view of an example of a swing path of a front end of the cushion plate in the nipper frame swing apparatus according to the invention.

The swing path of the front end of the nipper arm 4, and thus the cushion plate 5, resulting from use of this four-joint link mechanism is an upwardly facing arc 25, i.e., an arc with an inner surface facing away from the combing cylinder 3, as shown in FIG. 10. Also, since a four-joint link mechanism is used, the center of curvature at different points of the arc gradually changes. Therefore, suitable selection of the dimensions of the parts of the four-joint link mechanism enables the front end of the cushion plate 5 to come closest to the combing cylinder 3 when the nipper frame retracts to the rearmost position and enables the swing path of the front end of the cushion plate 5 in the combing zone M to be made substantially parallel to the needles of the combing cylinder.

FIG. 10 shows a specific example of the swing path of the front end of the cushion plate 5. In FIG. 10, A indicates the front end of the cushion plate 5, B the swing fulcrum 6 of the nipper frame, C the nipper frame driving fulcrum 9, D the nipper frame setting fulcrum 7, and E the rotation center of the nipper shaft 10. As easily understood from FIG. 10, when the nipper shaft 10 rotates to swing the nipper frame driving arm 11 and the nipper frame driving fulcrum 9 moves from C→C′→C″, the front end of the cushion plate 5 moves from A→A′→A″. Near A″, the front end of the cushion plate 5 moves approximately parallel to the path 23 of the tips of the needles of the combing cylinder 3. As a result, the swing path of the front end of the cushion plate 5 becomes an upwardly facing arc 25, i.e., an arc with an inner surface facing away from the combing cylinder 3.

In the nipper frame swing apparatus of the present invention, it is preferable to set the distance $L_1$ between the rotation center of the nipper shaft and the nipper frame driving fulcrum, the distance $L_2$ between the nipper frame driving fulcrum and the nipper frame swing fulcrum, the distance $L_3$ between the nipper frame swing fulcrum and the nipper frame setting fulcrum, the distance 4 L between the nipper frame setting fulcrum and the rotation center of the nipper shaft, the relative position of the nipper shaft with respect to the combing cylinder, and the relative position of the front end of the cushion plate with respect to the nipper frame so that the swing path of the front end of the cushion plate, formed by the reciprocating rotational motion of the nipper shaft, is an upwardly facing arc formed by a succession of a plurality of arcs having centers of curvature at successively moving points located above the nipper frame and so that the front end of the cushion plate becomes closest to the combing cylinder when nipper frame retracts to the rearmost position.

The arc 25 of the embodiment shown in FIG. 10 is achieved by setting the location and length of the parts of the four-joint link mechanism, as follows:

Distance $L_1$ between E and C: 95 mm
Distance $L_2$ between B and C: 151 mm
Distance $L_3$ between B and D: 117 mm
Distance $L_4$ between D and E: 174 mm
Distance between A and B: 73 mm
Angle formed by line $\overline{BC}$ with line $\overline{AB}$: 101°
Angle formed by line $\overline{AC}$ with line $\overline{AB}$: 56°

These values are merely examples. If the four-joint link mechanism were constructed so that the vertical position of point E is between B and C, $L_3$: $L_1$=10:5 to 10:20, $L_2$: $L_4$=10:7 to 10:15, the angle $\alpha$ in FIG. 10 is between 90° to 120°, the angle $\beta$ is between 45° to 80°, and the angle $\theta$ is between 20° to 35°, then the front end of the cushion plate 5 can swing along the upwardly facing arc of this invention.

If the nipper frame swinging method and apparatus of this invention is used, various excellent effects arise.

As both the nipper frame swing arm 8 supporting the nipper frame 4 and the nipper frame driving arm 11 can be made comparatively short, the overall swing apparatus of the nipper frame can be made small and thus the inertia reduced. Therefore, the swing motion is stable and vibration is minimal. This is useful in reducing wear of the bearings of the fulcrums.

As the bearings of the nipper shaft 10 and nipper frame setting fulcrum 7 can be mounted on the same frame, the precision of positioning can be improved. As a result, the gauge between the front end of the cushion plate 5 and the tips of the needles of the combing cylinder 3 can be made uniform in the axial direction of the combing cylinder 3. This enables excellent combing action over whole width of the fleece. Moreover, unlike the known nipper frame swing apparatus, wherein the nipper shaft and nipper frame setting fulcrum have to be mounted on different frames, it is not necessary when assembling the nipper frame swing apparatus to adjust the mutual position of the bearings of the nipper shaft and nipper frame setting fulcrum.

As the nipper frame setting fulcrum 7 is located above the combing cylinder 3, maintenance work under the combing cylinder is facilitated and made safer.

As mentioned before, in the method and apparatus of the present invention, the front end of the cushion plate swings along an upwardly facing arc. Therefore, in the zone M of combing action, the gauge between the front end of combing plate 5 and the tops of the needles of the combing cylinder 3 can be held almost constant. This enables the gauge to be kept narrow and constant and an excellent combing action to be obtained. This is useful in obtaining a uniform, excellent combing sliver. Further, the swing distance L of the cushion plate 5 can be made shorter than that of the known apparatus, so vibration can be reduced. As a result, high speed operation can be achieved.

The feed roller 18 located over the cushion plate swings along the arc in the same manner as the cushion plate 5. In this case, if the guide fulcrum of the web being supplied to the feed roller 18 is arranged near the nipper frame setting fulcrum 7, the web fed upstream of the feed roller 18 can be kept at a practically constant degree of stretch no matter what the position of the cushion plate 5. Therefore, no weight unevenness occurs on the fleece subjected to the combing action, so no lap tension apparatus as used with known nipper frame swing apparatuses is necessary.

I claim:

1. An apparatus for swinging a nipper frame of a comber, which includes a nipper frame arranged above a combing cylinder of the comber and having a cushion plate on its front end; a nipper shaft arranged for reciprocating rotation to a machine frame of the comber at the top of said nipper frame; a nipper frame setting fulcrum provided on said machine frame at the top of said nipper frame and more forward than said nipper shaft; a nipper frame driving arm fired at its top end to said nipper shaft and pivoted at its bottom end to a nipper frame driving fulcrum located at the back of said nipper frame; and a nipper frame swing arm with a top end pivoted to said nipper frame setting fulcrum and bottom end pivoted to a nipper frame swing fulcrum located at the front of said nipper frame.

2. An apparatus as claimed in claim 1, wherein a distance $L_1$ between a rotation center of said nipper shaft and said nipper frame driving fulcrum, a distance $L_2$ between said nipper frame driving fulcrum and said nipper frame swing fulcrum, a distance $L_3$ between said nipper frame swing fulcrum and said nipper frame setting fulcrum, a distance $L_4$ between said nipper frame setting fulcrum and a rotation center of said nipper shaft, a relative position of said nipper shaft against the combing cylinder, and a relative position of a front end of said cushion plate against the nipper frame are set so the front end of said cushion plate is swung, by the reciprocating rotational motion of said nipper shaft, along an upwardly facing arc formed by a succession of a plurality of arcs with centers of curvature of successively moving points located above said nipper frame and so that the front end of said cushion plate becomes closest to the combing cylinder when said nipper frame retracts to the rearmost position.

* * * * *